US007038630B1

(12) United States Patent
Bally et al.

(10) Patent No.: US 7,038,630 B1
(45) Date of Patent: May 2, 2006

(54) AM/FM DUAL GRID ANTENNA

(75) Inventors: Nazar F. Bally, Sterling Heights, MI (US); Korkut Yegin, Grand Blanc, MI (US); Randall J. Snoeyink, Clarkson, MI (US); William R. Livengood, Grand Blanc, MI (US)

(73) Assignee: Delphi Technologies, Troy, MI (US)

( * ) Notice: Subject to any disclaimer, the term of this patent is extended or adjusted under 35 U.S.C. 154(b) by 0 days.

(21) Appl. No.: 10/985,559

(22) Filed: Nov. 10, 2004

(51) Int. Cl.
*H01Q 1/32* (2006.01)

(52) U.S. Cl. ..... 343/713; 343/704; 343/711

(58) Field of Classification Search ..... 343/713, 343/711, 712, 704; H01Q 1/32
See application file for complete search history.

(56) References Cited

U.S. PATENT DOCUMENTS 4,736,206 A * 4/1988 Sakurai et al. ..... 343/704
6,215,450 B1 * 4/2001 Oka ..... 343/713
6,943,741 B1 * 9/2005 Bally et al. ..... 343/713

* cited by examiner

*Primary Examiner*—Hoanganh Le
(74) *Attorney, Agent, or Firm*—Stefan V. Chmielewski

(57) ABSTRACT

An antenna disposed on glass including first and second spatially separated grid portions is disclosed. The first grid portion is electromagnetically coupled to the second grid portion to provide reception of AM and FM signals.

7 Claims, 3 Drawing Sheets

AM/FM DUAL GRID ANTENNA

TECHNICAL FIELD

This invention generally relates to vehicle radio antennas and more specifically relates to vehicle radio antennas which are integrated with the vehicle windows.

BACKGROUND OF THE INVENTION

In order to enhance a vehicle's aesthetic qualities, it is common to integrate vehicle radio antennas with one or more of the vehicle's windows (commonly known as hidden antenna systems or on-glass AM/FM antenna systems). Unlike mast (i.e. rod) antennas, on-glass antenna systems do not introduce any external vehicle protrusions and they typically offer excellent mechanical stability and satisfactory reception performance. Although on-glass antennas are widely used, they do suffer from various drawbacks. Specifically, on-glass antennas are difficult to design because a small change in a vehicle's body design can radically change the reception performance of the antenna.

On-glass antenna systems are usually fabricated by printing metallic conductors on an inner surface of the back-glass or the side-glass (FIG. 1) of a vehicle window. A low-noise-amplifier (LNA) circuit is typically mounted in close proximity to the on-glass antenna and is electrically coupled to the on-glass antenna to amplify the weak signal received by the antenna before it is sent to the radio receiver for further conditioning. The on-glass antennas are typically fed vertically (close to the vehicle roof) so that the LNA circuit can be housed in the vicinity where the vehicle roof intersects the window.

Referring to FIG. 2, it is also known to locate on-glass antennas on the back glass 3 (i.e. rear windshield glass) of a vehicle, V, to provide an AM/FM antenna system. As illustrated, the rear windshield glass 3 includes a plurality of horizontally-fed wires 4 that function as a defroster grid to melt or snow and ice from the glass 3. Additional grid lines (not shown) that are on or, in close proximity to the horizontal defroster grid lines 4 may also be used as the AM/FM antenna system. However, such additional grid line are generally not adequate to provide a desired signal reception performance.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
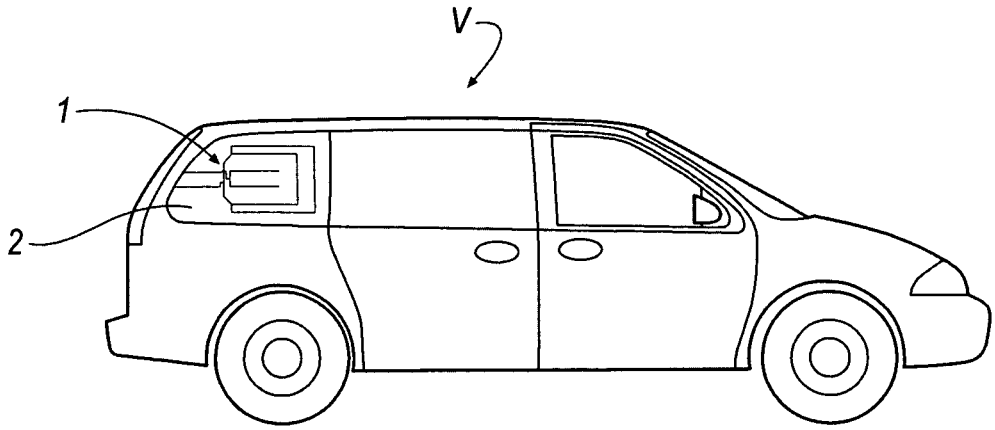
FIG. 1 (PRIOR ART)
FIG. 1 is an environmental view of a conventional on-glass antenna.
Figure 2:
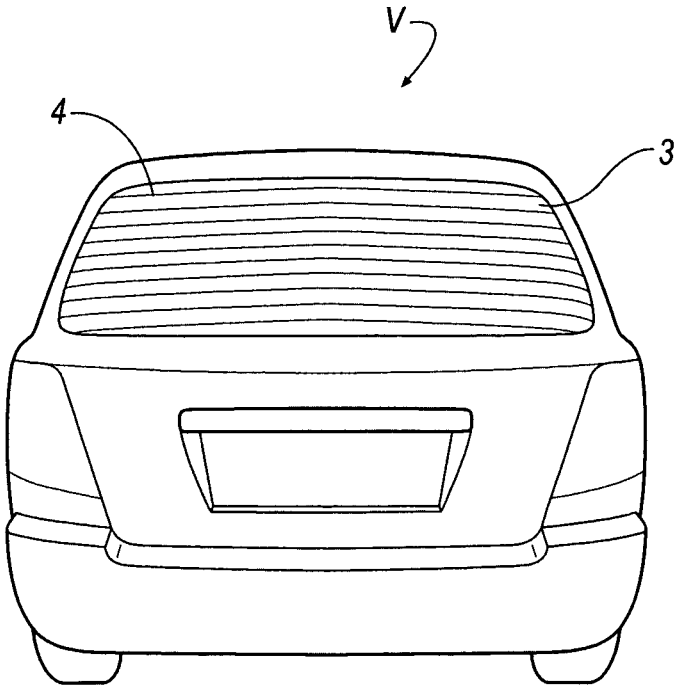
FIG. 2 (PRIOR ART)
FIG. 2 is a conventional environmental view of a defroster grid disposed on a rear-windshield glass.
Figure 3:
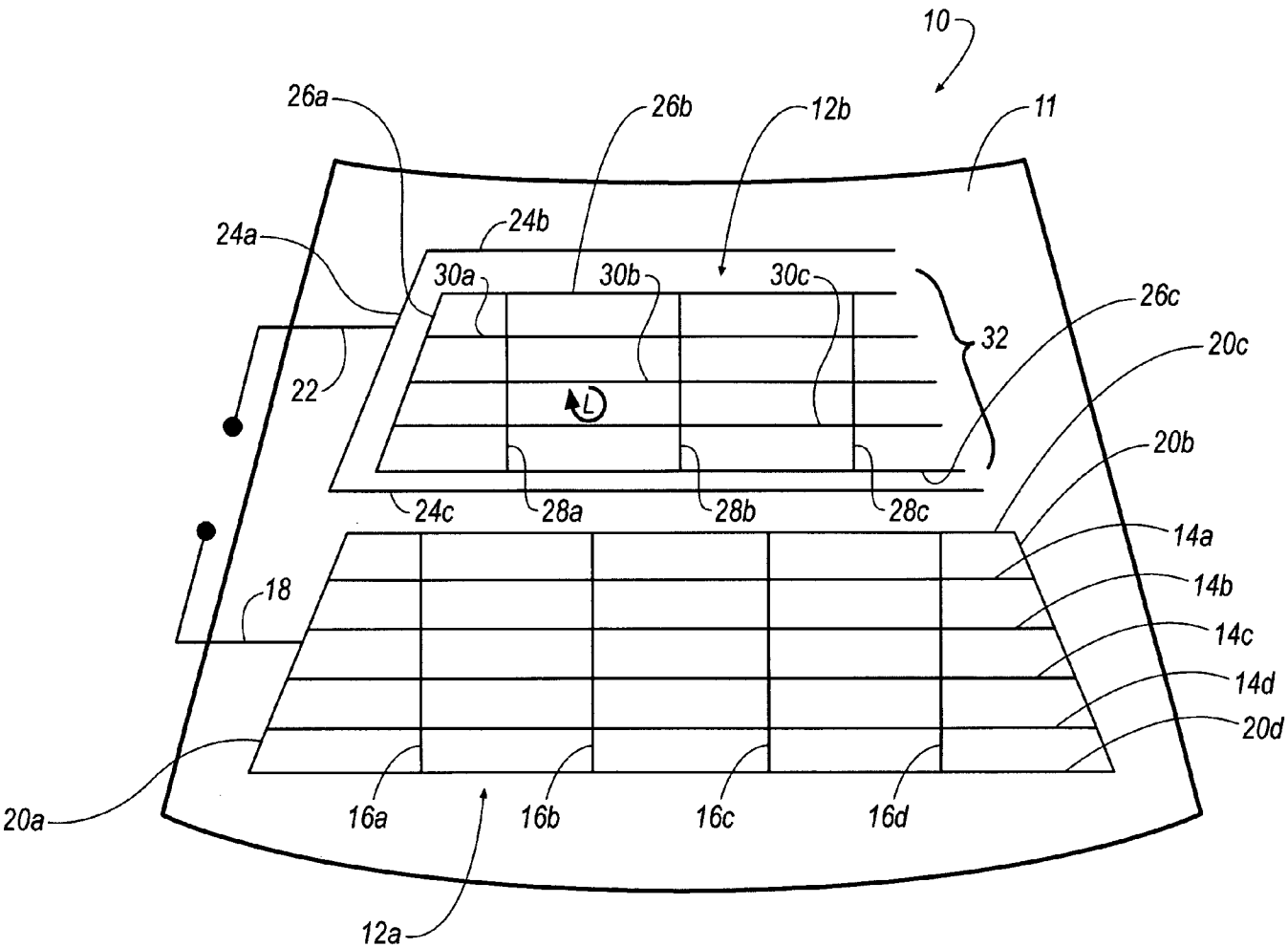
FIG. 3 is a dual grid antenna according to an embodiment.

Referring to FIG. 3, an AM/FM antenna 10 is shown located on a rear-windshield glass 11. Although the illustrated embodiment is disclosed in conjunction with a rear-windshield glass implementation, it is to be understood that the illustrated embodiment is not limited to a rear-windshield glass implementation and that the illustrated embodiment can just as easily be implemented on the side glass or front-windshield of a vehicle, V.

The AM/FM antenna consists of two separate wire-grid structures 12*a*, 12*b*. The first grid structure 12*a*, which is the FM antenna, utilizes the already existing defroster grid, which includes a plurality of horizontally-disposed wires 14*a*–14*d* and an added modification defined by a plurality of vertical wires 16*a*–16*d* and a defroster grid perimeter defined by side wires 20*a*, 20*b* and upper and lower wires 20*c*, 20*d*. The FM antenna 12*a* also includes a main feed 18 that extends generally horizontally and connects to the defroster-grid perimeter at the side wire 20*a*. As illustrated, the vertical wires 16*a*–16*d* intersect the horizontally disposed wires 14*a*–14*d* to connect the upper and lower wires 20*c*, 20*d*.

The second grid structure 12*b*, which is the AM antenna, is located above the FM antenna 12*a*. The AM antenna 12*b* includes a main feed 22 that extends generally horizontally and is connected to a bifurcated wire feed fork that includes a side wire 24*a* and upper and lower wires 24*b*, 24*c*. As illustrated, the AM antenna 12*b* is electromagnetically coupled to the bifurcated wire feed fork. A plurality of vertical wires 28*a*–28*c* intersect a plurality of horizontally disposed wires 30*a*–30*c* to connect the upper and lower wires 26*b*, 26*c*.

The side wire 26*a*, the upper and lower wires 26*b*, 26*c*, the vertical wires 28*a*–28*c*, and the horizontally-disposed wires 30*a*–30*c*, form multiple loop structures, which is shown for example, at the arrow, L, which is formed by the wires 28*a*, 28*c*, 30*b*, 30*c*. Accordingly, the loop structures, such as L, aid the directionality of the FM antenna pattern over its entire frequency range. Directionality is defined as the difference between maximum and minimum gains in a radiation pattern. For example, if the maximum gain is +3 dBd at 45° but the minimum gain is −8 dBd at 143°, then directionality is 11 dB. Typically, automotive original equipment manufacturers (OEM) specify the directionality at 15 dBd.

As illustrated, the AM antenna 12*b* includes a generally defined 'open end,' which is designated generally at 32, such that the horizontally-disposed wires 30*a*–30*c* are not connected by a vertical wire, which is similar to the side wire 26*a* that connects the upper and lower wires 26*b*, 26*c*. As illustrated, the FM and AM grids 12*a*, 12*b*, although spatially separated, are electromagnetically-coupled. The location of the AM antenna grid 12*b* also provides a uniform ground for FM antenna 12*b*, which, as a result, improves overall FM antenna performance.

Figure 4:
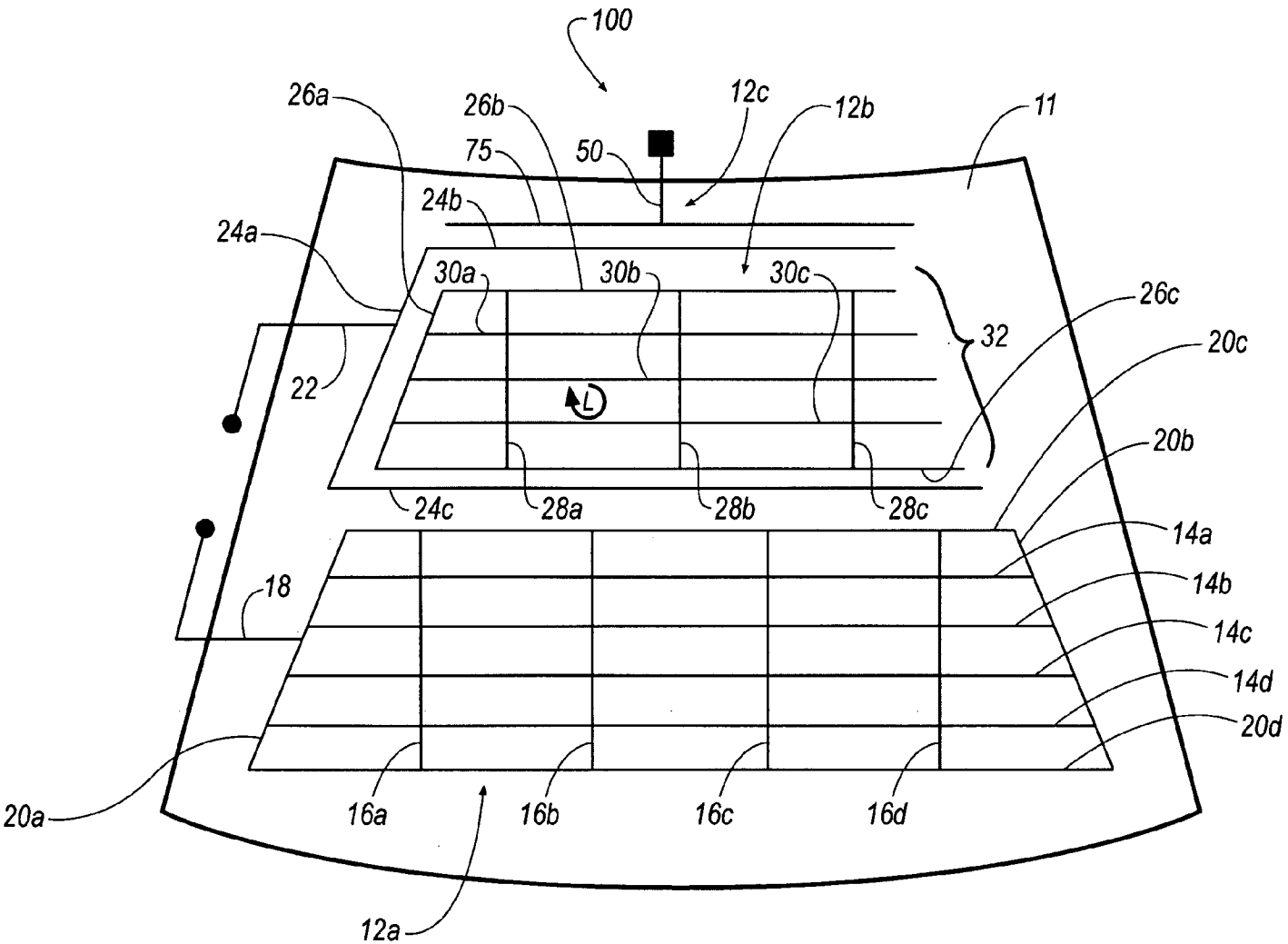
FIG. 4 is a dual grid antenna according to another embodiment.

Referring to FIG. 4, another embodiment of the invention is disclosed generally at reference numeral 100, which includes a remote keyless entry (RKE)/tire pressure monitoring (TPM) antenna 12*c* located substantially above the AM antenna 12*b*. The RKE/TPM antenna 12*c* includes a feed line 50 and an antenna element 75. The horizontal length of the antenna element 75 is not relatively long enough and the inverted T-structured spacing from the vehicle roof (not shown) formed by the feed line 50 does not interfere with the operation of the AM antenna 12*b*. Therefore, by being able to locate the RKE/TPM antenna 12*c* on the same glass 11 as the FM and AM antennas 12*a*, 12*b*, additional design flexibility is enabled without compromising the operation of the FM or AM antennas 12*a*, 12*b*.

All of the embodiments disclosed herein have a preferred range of antenna conductor width of 0.25 mm to 1.50 mm. However, it will be appreciated that other conductor widths may be used if desired. As such, it is recognized that those skilled in the art may make various modifications or additions to the embodiments chosen here to illustrate the present invention, without departing from the spirit of the present invention. Accordingly, it is to be understood that the subject matter sought to be afforded protection hereby should be deemed to extend to the subject matter defined in the appended claims, including all fair equivalents thereof.

What is claimed as new and desired to be protected by Letters Patent of the United States is:

1. An antenna comprising:

a first antenna grid located on a vehicle glass that utilizes a first side wire connected to a first upper wire and a fist lower wire, and a first plurality of vertical wires that intersect a first plurality of horizontally disposed wires extending from the first side wire to connect the first upper wire and the first lower wire, wherein, a bifurcated wire feed fork is electromagnetically coupled to the first antenna grid; and a second antenna grid located on the vehicle glass that is spatially separated from and located below the first antenna grid, wherein the second antenna grid utilizes a plurality of defroster grid wires, a defroster wire grid perimeter, and a second plurality of vertical wires that intersect the plurality of defroster grid wires to connect an upper defroster grid wire and lower defroster grid wire of the defroster wire grid perimeter.

2. The antenna according to claim 1, wherein a first feed is connected to the bifurcated wire feed fork and a second feed is connected to a defroster grid side wire perimeter of the defroster grid wire perimeter.

3. The antenna according to claim 1, wherein multiple loop structures are formed by the first side wire, the first upper wire, the fist lower wire, the first plurality of vertical wires, and the first plurality of horizontally disposed wires to maintain the directionality of the second antenna grid's antenna pattern over the second antenna grid's entire frequency range.

4. The antenna according to claim 1, wherein the first antenna grid further comprises an open end such that the first plurality of horizontally-disposed wires are not intersected at an end of the first antenna grid opposite the first side wire.

5. The antenna according to claim 1, wherein all the wires defining the first and second antenna grids include a width of 0.25 mm to 1.50 mm.

6. The antenna according to claim 1, wherein the first antenna grid is an AM antenna and the second antenna grid is an FM antenna.

7. The antenna according to claim 1 further comprising an inverted T-structure antenna located on the vehicle glass that is spatially separated from and located above the first antenna grid, wherein the inverted T-structure antenna is a remote keyless entry/tire pressure monitoring system (RKE/TPM) antenna.

* * * * *